US009982466B2

(12) United States Patent
Enomoto et al.

(10) Patent No.: US 9,982,466 B2
(45) Date of Patent: May 29, 2018

(54) VEHICLE DOOR LATCH DEVICE

(71) Applicants: MITSUI KINZOKU ACT CORPORATION, Kanagawa (JP); GECOM CORPORATION, Greensburg, IN (US)

(72) Inventors: Daisuke Enomoto, Kanagawa (JP); Brian Kepler, Novi, MI (US)

(73) Assignees: MITSUI KINZOKU ACT CORPORATION, Kanagawa (JP); GECOM CORPORATION, Greensburg, IN (US)

( * ) Notice: Subject to any disclaimer, the term of this patent is extended or adjusted under 35 U.S.C. 154(b) by 214 days.

(21) Appl. No.: 14/913,658

(22) PCT Filed: Dec. 24, 2014

(86) PCT No.: PCT/JP2014/084143
§ 371 (c)(1),
(2) Date: Feb. 22, 2016

(87) PCT Pub. No.: WO2016/035224
PCT Pub. Date: Mar. 10, 2016

(65) Prior Publication Data

US 2016/0290016 A1 Oct. 6, 2016

(30) Foreign Application Priority Data

Sep. 4, 2014 (JP) ..... 2014-179806

(51) Int. Cl.
*E05C 3/06* (2006.01)
*E05B 81/70* (2014.01)
(Continued)

(52) U.S. Cl.
CPC ..... *E05B 81/70* (2013.01); *E05B 77/16* (2013.01); *E05B 81/66* (2013.01); *E05B 77/34* (2013.01);
(Continued)

(58) Field of Classification Search
None
See application file for complete search history.

(56) References Cited

U.S. PATENT DOCUMENTS 6,264,253 B1 7/2001 Takaishi
6,428,059 B2 * 8/2002 Kobayashi ..... E05B 85/26 292/201
(Continued)

FOREIGN PATENT DOCUMENTS

CN 103075054 A 5/2013
CN 103670065 A 3/2014
(Continued)

OTHER PUBLICATIONS

Computer Generated Translation for DE 10351424, Generated on Nov. 17, 2017, https://worldwide.espacenet.com/ (Year: 2017).*
(Continued)

*Primary Examiner* — Alyson M Merlino
(74) *Attorney, Agent, or Firm* — McDermott Will & Emery LLP

(57) ABSTRACT

A vehicle door latch device includes: a base fixed to a door; a latch pivotally supported on the base, and configured to be rotatable in association with opening and closing of the door, the latch having a cam portion on an outer periphery thereof; a detection lever pivotally supported on the base by a shaft, the detection lever having a detecting portion, which slides along the cam portion in association with rotation of the latch, and a cam surface, the detection lever being configured to be rotatable, by the detecting portion sliding along the cam portion, to a position corresponding to a rotational position of the latch; and a detection switch configured to detect open and closed states of the door by being turned ON
(Continued)

and OFF by coming into contact with and separating from the cam surface in association with rotation of the detection lever.

2 Claims, 11 Drawing Sheets

(51) Int. Cl.

| | |
|---|---|
| ***E05B 81/66*** | (2014.01) |
| ***E05B 77/16*** | (2014.01) |
| *E05C 3/16* | (2006.01) |
| *E05B 81/06* | (2014.01) |
| *E05B 85/24* | (2014.01) |
| *E05B 77/34* | (2014.01) |
| *E05B 81/16* | (2014.01) |
| *E05B 81/50* | (2014.01) |

(52) U.S. Cl.
CPC ..... *E05B 81/06* (2013.01); *E05B 81/16* (2013.01); *E05B 81/50* (2013.01); *E05B 85/243* (2013.01)

(56) References Cited

U.S. PATENT DOCUMENTS

| | | | |
|---|---|---|---|
| 9,290,969 | B2 | 3/2016 | Yokota et al. |
| 9,328,540 | B2 | 5/2016 | Yokomori et al. |
| 2001/0050484 | A1 | 12/2001 | Kobayashi et al. |
| 2011/0154740 | A1 | 6/2011 | Matsumoto et al. |
| 2013/0049379 | A1 | 2/2013 | Yokota et al. |
| 2014/0062101 | A1 | 3/2014 | Yokomori et al. |

FOREIGN PATENT DOCUMENTS

| | | | | |
|---|---|---|---|---|
| DE | 10351424 | A1 * | 6/2004 | ..... E05B 81/06 |
| DE | 102013000853 | A1 | 7/2014 | |
| GB | 2396656 | A | 6/2004 | |
| JP | 4-277279 | A | 10/1992 | |
| JP | 2533005 | B2 | 9/1996 | |
| JP | 08-333933 | A | 12/1996 | |
| JP | 2001-241247 | A | 9/2001 | |
| JP | 2004-156330 | A | 6/2004 | |
| JP | 2008-240397 | A | 10/2008 | |

OTHER PUBLICATIONS

Office Action dated Mar. 17, 2017, issued in corresponding Chinese Patent Application No. 201480054934.1.

Extended European Search Report dated Mar. 24, 2017, issued in corresponding European Application No. 14896277.2.

International Search Report dated Mar. 17, 2015, issued in corresponding International Application No. PCT/JP2014/084143.

* cited by examiner

VEHICLE DOOR LATCH DEVICE

RELATED APPLICATIONS

This application is the U.S. National Phase under 35 U.S.C. § 371 of International Patent Application No. PCT/JP2014/084143, filed on Dec. 24, 2014, which in turn claims the benefit of Japanese Patent Application No. 2014479806, which was filed on Sep. 4, 2014, the disclosures of which are hereby incorporated by reference.

FIELD

The present invention relates to a vehicle door latch device including a detection switch for detecting open and closed states of a door.

BACKGROUND

Conventionally, in a vehicle door latch device, for example, as described in Patent Literature 1: a latch, a detection lever (a cam in Patent Literature 1), and a detection switch are arranged in a synthetic resin body that is fixed inside a door of a vehicle; a bulged portion bulged out in an axial direction of the latch is integrally formed on a surface of the latch; and rotational positions of the latch, that is, open and closed states of the door, are detected by the detection switch being turned ON and OFF by the bulged portion via the detection lever.

CITATION LIST

Patent Literature

Patent Literature 1: Japanese Patent No. 2533005

SUMMARY

Technical Problem

However, since the vehicle door latch device described in Patent Literature 1 has the configuration in which the detection lever and the detection switch are arranged, together with the latch, on a surface side (a side facing an outdoor side) of the synthetic resin body where dust, rainwater, and the like easily enter, the dust, rainwater, and the like that have entered the surface side of the synthetic resin body are attached to the detection switch, and thus the configuration is not preferable in terms of waterproofness.

In view of the above problem, an object of the present invention is to provide a vehicle door latch device that has excellent waterproofness and is able to surely detect open and closed states of a door.

Solution to Problem

To achieve the above-described object, a first invention includes: a base fixed to a door; a latch pivotally supported on a surface side of the base, and configured to be rotatable in association with opening and closing of the door, the latch having a cam portion on an outer periphery thereof; a detection lever pivotally supported on a reverse side of the base by a shaft parallel with an axial direction of the latch, the detection lever having a detecting portion, which penetrates through an elongated hole provided in the base into the surface side and slides along the cam portion in association with rotation of the latch, and a cam surface provided on an opposite side of the detecting portion across the shaft, the detection lever being configured to be rotatable, by the detecting portion sliding along the cam portion in association with rotation of the latch, to a position corresponding to a rotational position of the latch; and a detection switch provided on the reverse side of the base and configured to be able to detect open and closed states of the door by being turned ON and OFF by coming into contact with and separating from the cam surface in association with rotation of the detection lever.

A second invention includes: a base fixed to a door; a latch pivotally supported on a surface side of the base, and configured to be rotatable between a fully latched position and an open position in association with opening and closing of the door, the latch having a cam portion on an outer periphery thereof; a locking and unlocking mechanism configured to be switchable, based on operation of a locking and unlocking operation unit provided in the door, to an unlocked position where opening operation on an operation handle provided on the door is validated and to a locked position where the opening operation on the operation handle is invalidated; a detection lever pivotally supported on a reverse side of the base by a shaft parallel with an axial direction of the latch, the detection lever having a detecting portion, which penetrates through an elongated hole provided in the base into the surface side and slides along the cam portion in association with rotation of the latch, and a cam surface provided on an opposite side of the detecting portion across the shaft, the detection lever being configured to be rotatable, by the detecting portion sliding along the cam portion in association with rotation of the latch, to a position corresponding to a rotational position of the latch; and a detection switch provided on the reverse side of the base and configured to be able to detect open and closed states of the door by being turned ON and OFF by coming into contact with and separating from the cam surface in association with rotation of the detection lever. The detection lever further has a blocking portion that allows switchover to the locked position of the locking and unlocking mechanism by retracting outside a rotation track of the locking and unlocking mechanism when the blocking portion is at a first rotational position corresponding to the fully latched position of the latch, and blocks movement of the locking and unlocking mechanism to the locked position by advancing into a movement track of the locking and unlocking mechanism when the blocking portion is at a second rotational position corresponding to a position other than the fully latched position of the latch.

According to a third invention, in the first invention or the second invention, the cam surface of the detection lever has a shape that bulges out in the axial direction, and the detection switch is arranged to face the cam surface.

According to a fourth invention, in the second invention, the locking and unlocking mechanism is configured to be rotatable about a shaft orthogonal to the shaft of the detection lever, and to be prevented from rotating to the locked position by abutting against a surface of the blocking portion when the detection lever is at the second rotational position.

According to a fifth invention, in the fourth invention, the base has a receiving portion against which a reverse surface of the blocking portion is abuttable when the detection lever is at the second rotational position and the blocking portion is blocking rotation of the locking and unlocking mechanism to the locked position.

Advantageous Effects of Invention

According to the first invention, by the detection lever and the detection switch being provided on the reverse side of the base where dust, rainwater, and the like are difficult to be attached, excellent waterproofness is achieved, and open and closed states of the door are able to be surely detected over a long period of time.

According to the second invention, in addition to the effects of the first invention, with the simple configuration, the switch-over operation of the locking and unlocking mechanism to the locked position is able to be blocked when the door is in the open state.

DESCRIPTION OF EMBODIMENTS

Figure 1:
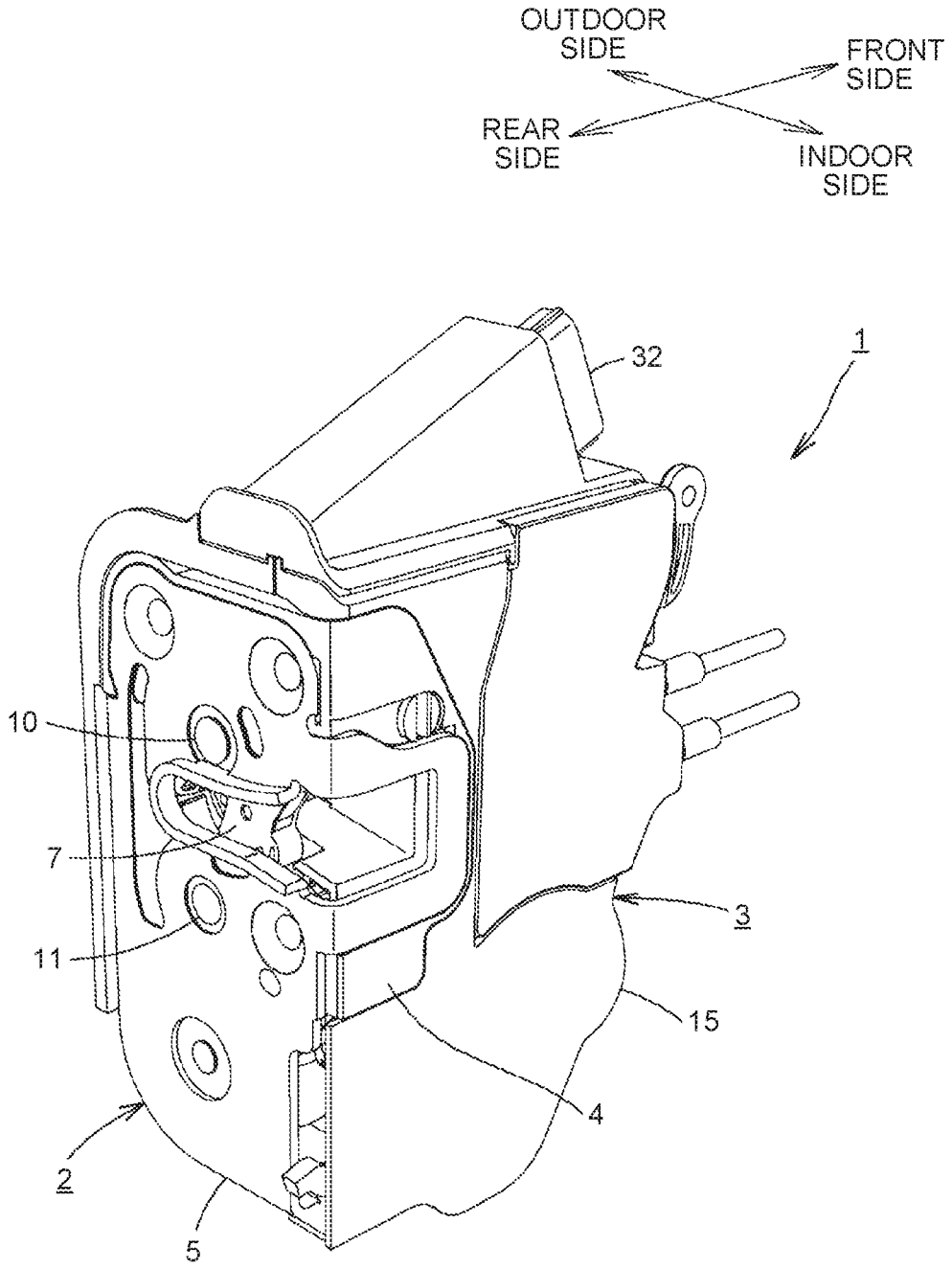
FIG. 1 is a perspective view of a vehicle door latch device according to the present invention as obliquely viewed from the front.

Hereinafter, an embodiment of the present invention will be described, based on the drawings.

(Basic Configuration of Door Latch Device 1)

As illustrated in FIGS. 1 to 4, a door latch device 1 is installed in a front door (hereinafter, referred to as "door") of a vehicle, and includes an engaging unit 2 for holding the door in a closed state, and an operating unit 3 that is assembled to the engaging unit 2.

The engaging unit 2 includes, as illustrated in FIGS. 5 to 10, as main elements: a base (without a symbol) including a body 4, which is fixed by a bolt (illustration omitted) to a rear end portion inside the door and is made of synthetic resin; a cover plate 5, which blocks an opening facing a surface side of the body 4 (a rear surface side facing the outside of the door); and a back plate 6, which is fixed to a reverse side of the body 4 (a front surface side facing the inside of the door) and is made of metal; an engaging mechanism (without a symbol), which is accommodated in the base and includes a latch 7 that is engageable with a striker S fixed to a vehicle body side, and a ratchet 8 that is engageable with the latch 7; and an open lever 9 that causes an engagement relation between the ratchet 8 and the latch 7 to be canceled. To clearly illustrate the engaging mechanism, in FIGS. 5, 7, and 9, the cover plate 5 is omitted.

The body 4 has, on the surface side facing a rear side (on the side facing the outside of the door), an accommodating portion 41, which is concave, for accommodating the latch 7 and the ratchet 8.

Figure 5:
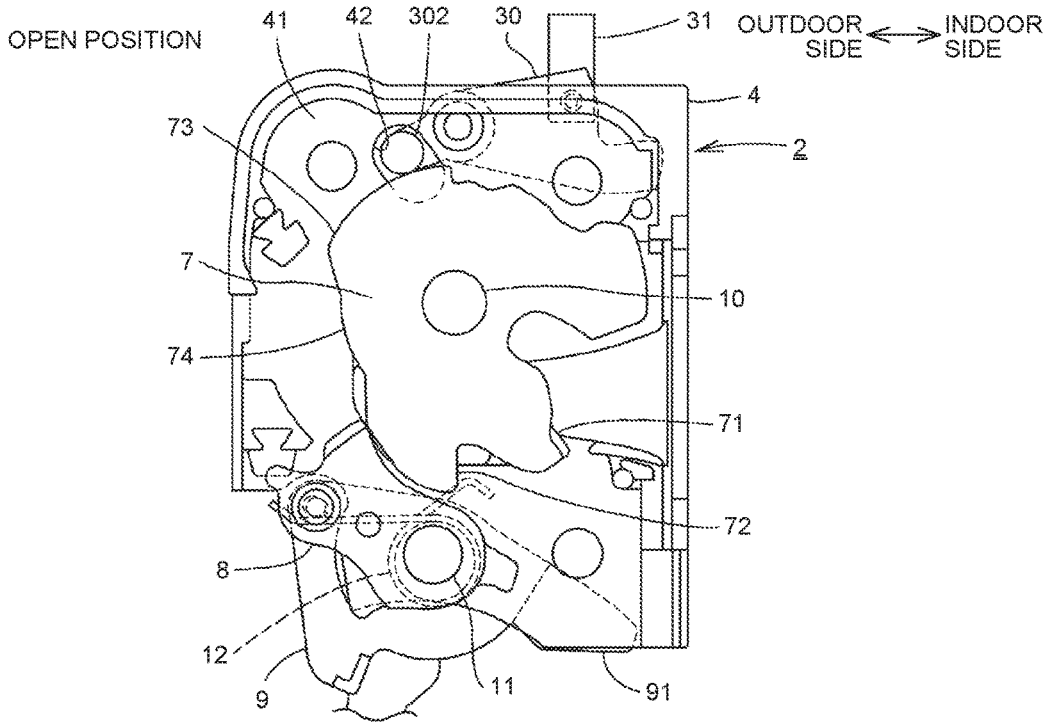
FIG. 5 is a front view of an engaging unit at an open position.
Figure 7:
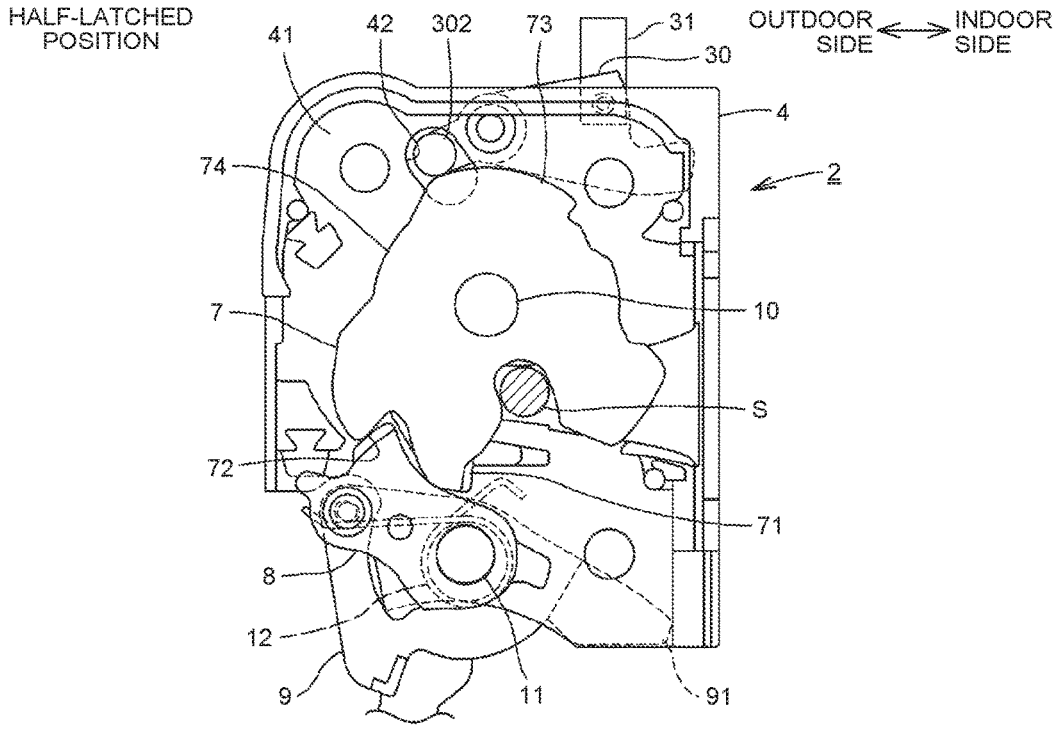
FIG. 7 is a front view of the engaging unit at a half-latched position.
Figure 9:
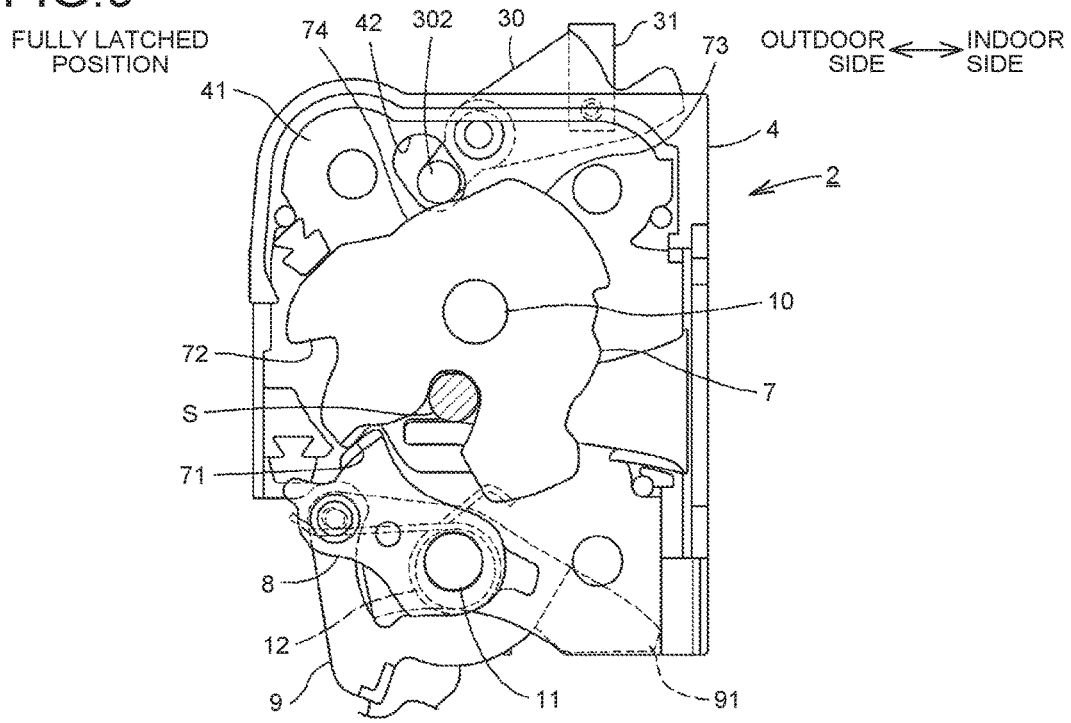
FIG. 9 is a front view of the engaging unit at a fully-latched position.

The latch 7 is pivotally supported by a latch shaft 10 that is in a front-rear direction, between the accommodating portion 41 of the body 4 and the cover plate 5. As illustrated in FIGS. 5, 7, and 9, at an outer peripheral lower portion of the latch 7, a full latch engaging portion 71 and a half latch engaging portion 72, with which the ratchet 8 is engageable, are provided.

Further, the latch 7 rotates in a clockwise direction against biasing force of a spring not illustrated, from an open position (the position illustrated in FIG. 5), in association with closing operation of the door, and rotates to a fully latched position (the position illustrated in FIG. 9) by passing a half-latched position (the position illustrated in FIG. 7). The latch 7 rotates oppositely to this when opening operation of the door is performed. The open position corresponds to an open state of the door where the latch 7 is not engaged with the striker S. The half-latched position corresponds to a half closed state of the door where the latch 7 is slightly engaged with the striker S. The fully latched position corresponds to a fully closed state of the door where the latch 7 is completely engaged with the striker S.

The ratchet 8 is below the latch 7, and is pivotally supported, between the accommodating portion 41 of the body 4 and the cover plate 5, by a ratchet shaft 11 that is in the front-rear direction. This ratchet 8 is biased in an engaging direction (a clockwise direction in FIGS. 5, 7, and 9, and a direction of engaging with the full latch engaging portion 71 and the half latch engaging portion 72 of the latch 7) by a spring 12, and in association with rotation of the latch 7, holds the door in the fully closed state by engaging with the full latch engaging portion 71 of the latch 7 and holds the door in the half closed state by engaging with the half latch engaging portion 72.

The open lever 9 is pivotally supported on the same shaft as the ratchet 8 and to be integrally rotatable with the ratchet 8, on the reverse side of the body 4 facing the front (the side facing the inside of the door). A released portion 91 is provided at an end portion of the open lever 9, the end portion extending to an indoor side.

Figure 2:
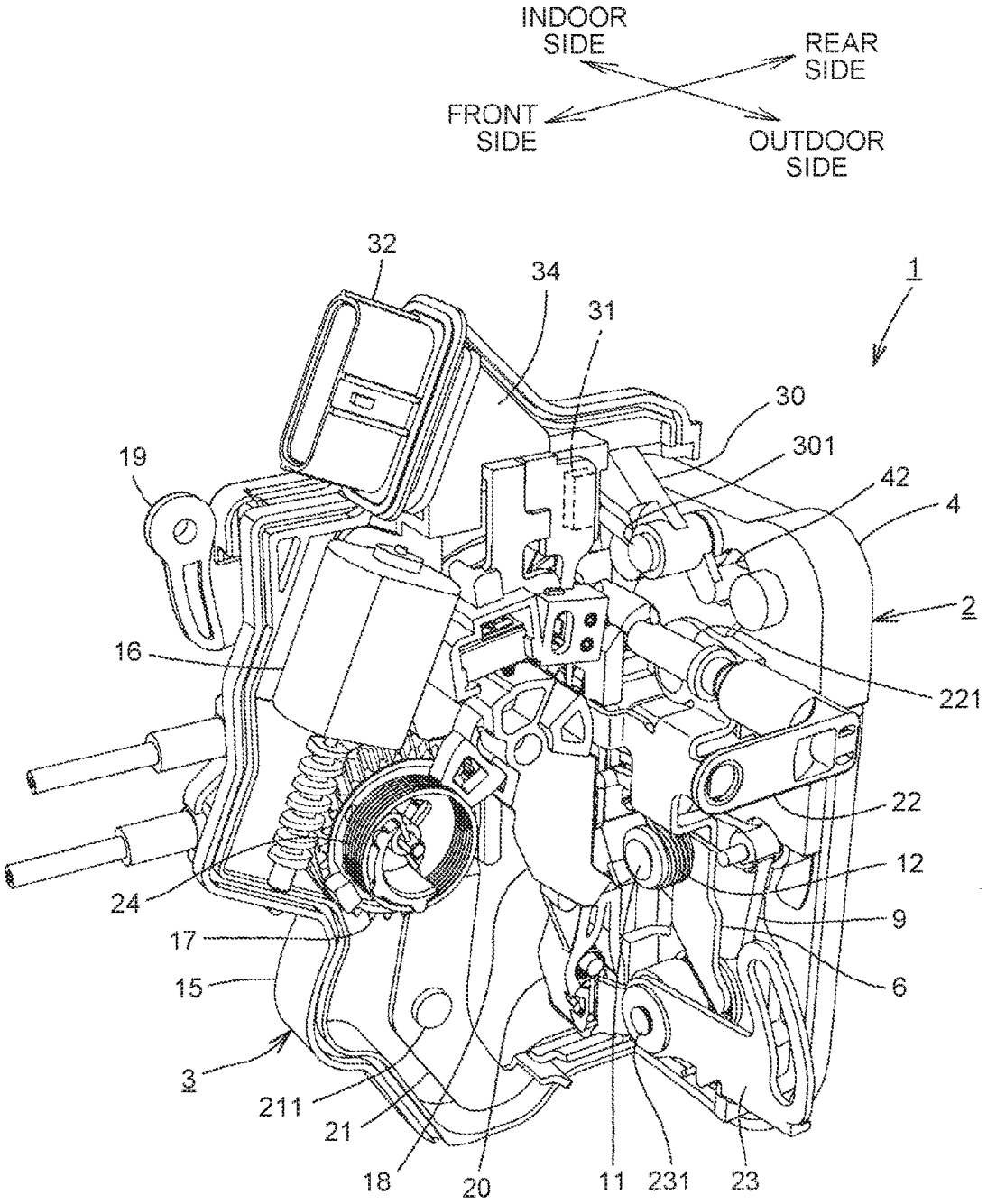
FIG. 2 is a perspective view of the same door latch device as obliquely viewed from the back.
Figure 3:
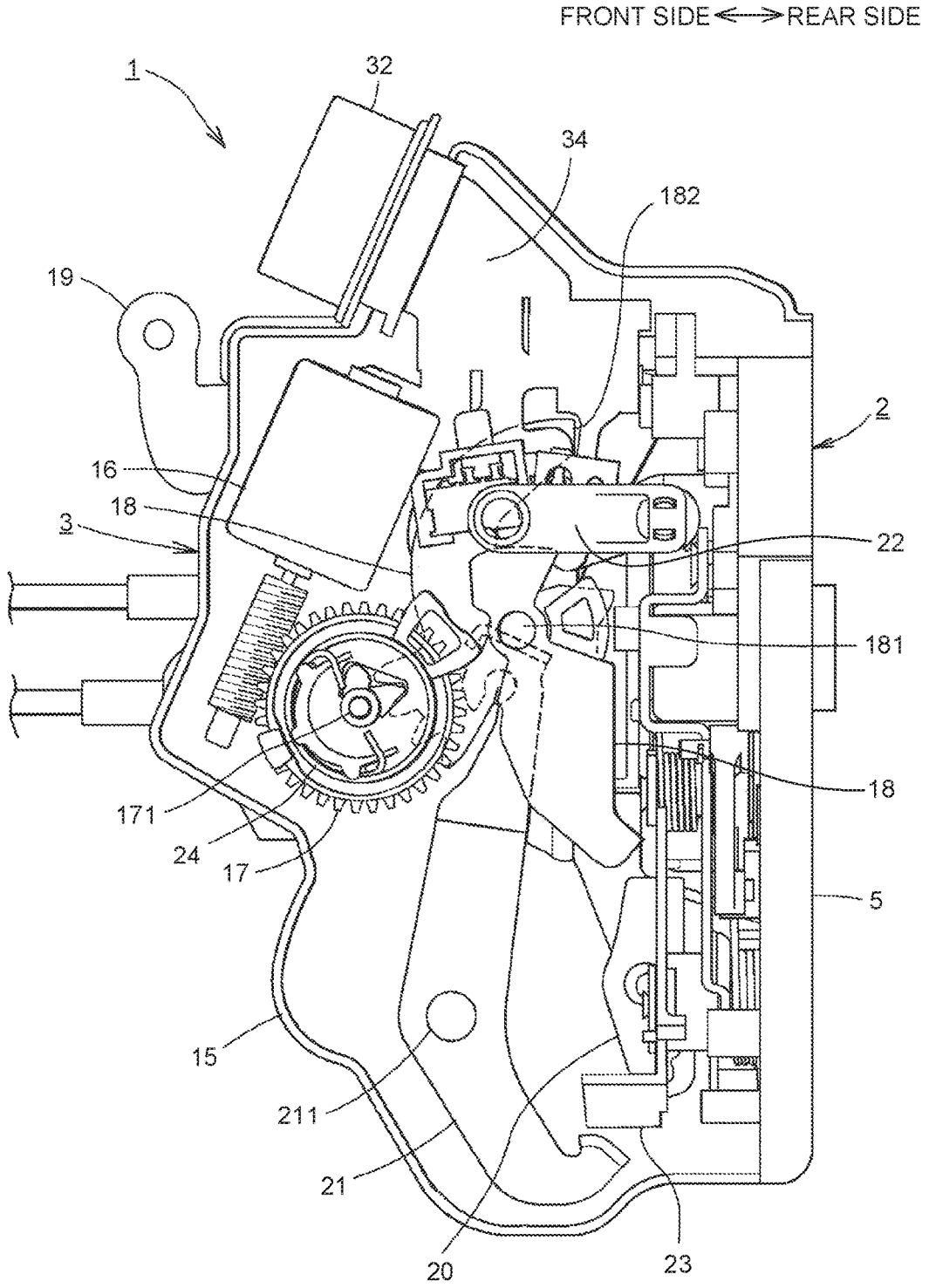
FIG. 3 is a side view of the same door latch device as viewed from an outdoor side.
Figure 4:
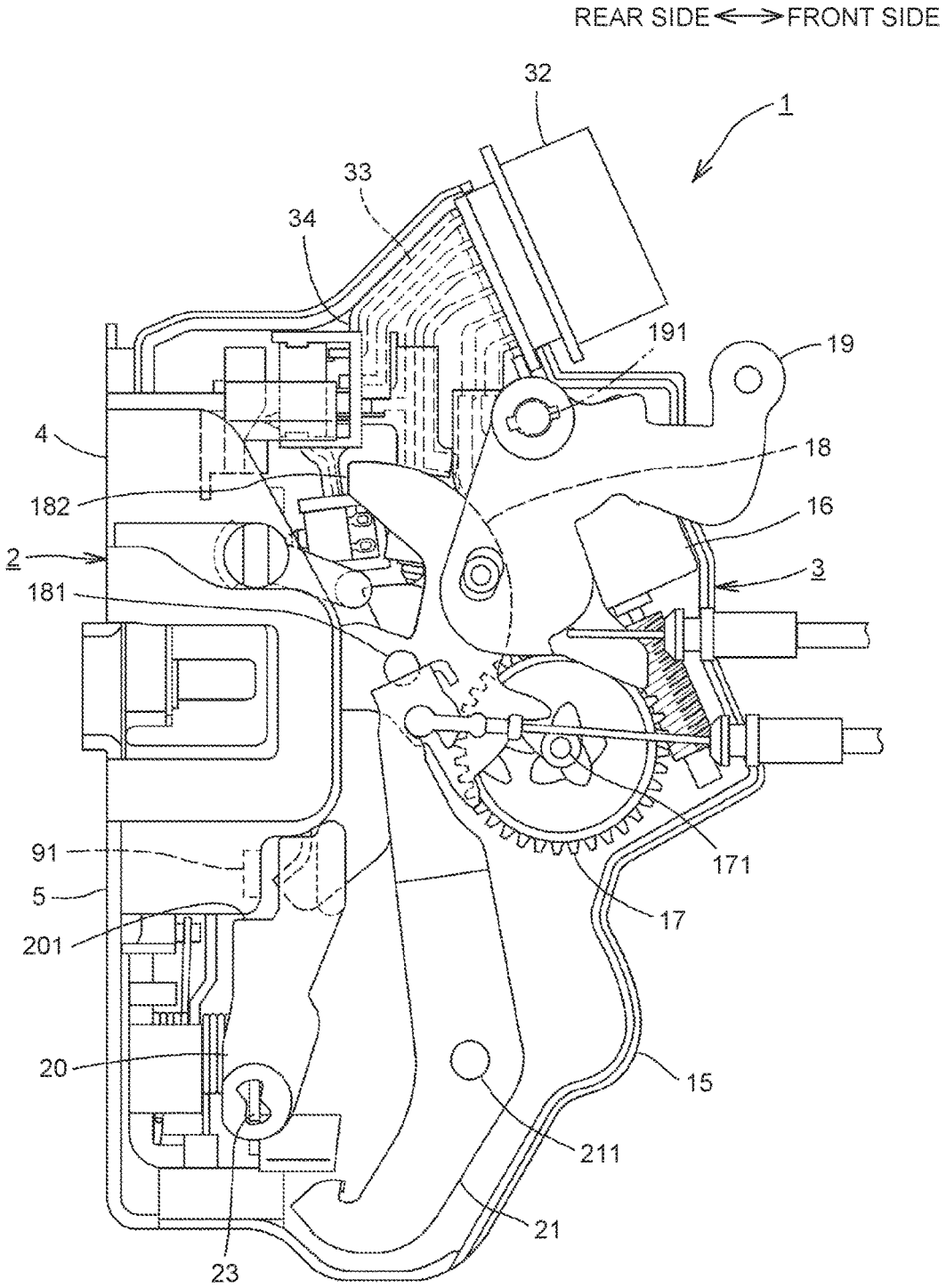
FIG. 4 is a side view of the same door latch device as viewed from an indoor side.

Mainly, as illustrated in FIGS. 2 to 4, the operating unit 3 includes: a casing 15, which is fixed to the body 4 and is made of synthetic resin; and an operating mechanism (without a symbol) accommodated in the casing 15. The operating mechanism is configured to include, as main elements: a motor 16; a worm wheel 17 that is reciprocally rotatable by rotation of the motor 16; a lock lever 18 that is movable to an unlocked position where door opening operation is validated and to a locked position where door opening operation is invalidated; a knob lever 19 that is coupled to a lock knob (illustration omitted) provided on an indoor side of the door; an open link 20 that is movable, with the lock lever 18, to the unlocked position and the locked position; an inside lever 21 that is coupled to an inside handle (illustration omitted) for door opening operation provided on the indoor side of the vehicle; a key lever 22 that is coupled to a key cylinder (illustration omitted) provided on an outdoor side of the door; and an outside lever 23 that is coupled to an outside handle (illustration omitted) for door opening operation provided on the outdoor side of the door. The lock lever 18, the knob lever 19, and the open link 20 form a locking and unlocking mechanism according to this embodiment.

In order to clearly illustrate an internal configuration of the operating unit 3, in FIGS. 2 to 4, illustration is made by omitting a part of the casing 15, which is fixed to cover the reverse side of the body 4 and is made of synthetic resin.

The worm wheel 17 is pivotally supported by a shaft 171 facing the inside of the vehicle. This worm wheel 17 reciprocally rotates from a neutral position (the position illustrated in FIGS. 3 and 4) against biasing force of a spring 24 when the motor 16 rotates, and returns to the neutral position from the rotated position by resilience of the spring 24 when rotation of the motor 16 stops.

The knob lever 19 is pivotally supported in the casing 15 by a shaft 191 that is in an indoor-outdoor direction. The knob lever 19 rotates, based on operation on the lock knob, to an unlocked position illustrated in FIG. 4 and to a locked position rotated by a predetermined angle in a clockwise direction from the unlocked position.

The key lever 22 is pivotally supported by a shaft 221 that is in the indoor-outdoor direction. This key lever 22 rotates, based on operation on the key cylinder, from a neutral position (the position illustrated in FIG. 3) in an unlocking direction and a locking direction.

The lock lever 18 is pivotally supported in the casing 15 by a shaft 181 that is in the indoor-outdoor direction. This lock lever 18 is rotatable to the unlocked position (the position illustrated in FIGS. 3, 4, 11, 12, 14, and 15) and the locked position (the position illustrated in FIG. 13), by: the rotation of the key lever 22 based on the operation on the key cylinder; the rotation of the knob lever 19 based on the operation on the lock knob; and the rotation of the worm wheel 17 based on the rotation of the motor 16. The unlocked position of the lock lever 18 is the position where the opening operation on the outside handle and inside handle is validated, and the locked position of the lock lever 18 is the position which is rotated by a predetermined angle in a clockwise direction in FIG. 12 from the unlocked position and where the opening operation on the outside handle and inside handle is invalidated. The lock lever 18 is elastically held at the unlocked position and locked position by biasing force of a spring, which is supported in the casing 15 and is not illustrated.

A lower portion of the open link 20 is coupled to be rotatable by a predetermined angle in the front-rear direction to an end portion of the outside lever 23, the end portion being on the indoor side, and an upper portion of the open link 20 is coupled to the lock lever 18 to be slidable in an up-down direction. The open link 20 rotates to an unlocked position illustrated in FIG. 4 and to a locked position rotated by a predetermined angle in a clockwise direction from the unlocked position, about a lower portion of the open link 20, in conjunction with operation of the lock lever 18. At an approximately central portion of the open link 20 in the up-down direction, a releasing portion 201, which is abuttable from below and against the released portion 91 of the open lever 9 when the open link 20 is at the unlocked position, is provided.

The outside lever 23 is pivotally supported by a shaft 231 in the front-rear direction at a lower side of the body 4. This outside lever 23 release operates, based on opening operation on the outside handle, against biasing force of a spring not illustrated, and moves the open link 20 upwards by the release operation.

The inside lever 21 is pivotally supported by a shaft 211 that is in the indoor-outdoor direction. Based on opening operation on the inside handle, this inside lever 21 release operates in a clockwise direction in FIG. 4 about the shaft 211, and transmits the release operation to the open link 20 via the outside lever 23.

When the door is in the fully closed state, and the lock lever 18, the knob lever 19, and the open link 20 are in the unlocked position as illustrated in FIGS. 3 and 4, the open link 20 release operates upwards from the unlocked position as the outside lever 23 release operates based on opening operation on the outside handle or inside handle. When the open link 20 release operates, the releasing portion 201 abuts from below and against the released portion 91 of the open lever 9 and the open lever 9 rotates in a releasing direction. Thereby, the ratchet 8 moves away from the full latch engaging portion 71 of the latch 7, and allows the door to be opened.

Further, when the door is in the fully closed state and the lock lever 18, the knob lever 19, and the open link 20 are in the locked position, even if the open link 20 release operates by release operation of the outside lever 23, the releasing portion 201 moves without hitting the released portion 91 of the open lever 9. Therefore, the open lever 9 is unable to be rotated in the releasing direction even if the open link 20 release operates, and thus the door is unable to be opened.

(Configuration of Characteristic Parts)

As mainly illustrated in FIGS. 5, 7, and 9, the latch 7 has a cam portion 73 at an upper outer periphery thereof, the cam portion 73 bulging out in a radial direction, and a small diameter portion 74 extending from the cam portion 73.

The cam portion 73 has a circular arc shape having a predetermined length in a circumferential direction with the latch shaft 10 being the center, and is shaped to be more largely bulged out in the radial direction than the small diameter portion 74.

Figure 6:
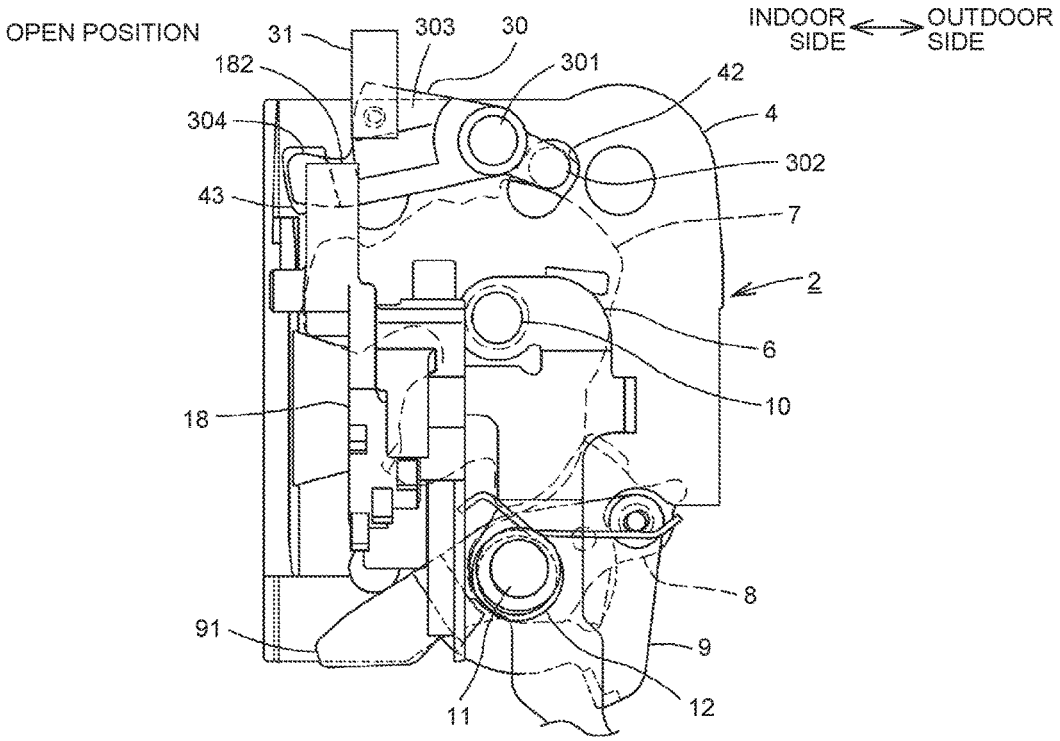
FIG. 6 is a rear view of the engaging unit at the open position.
Figure 8:
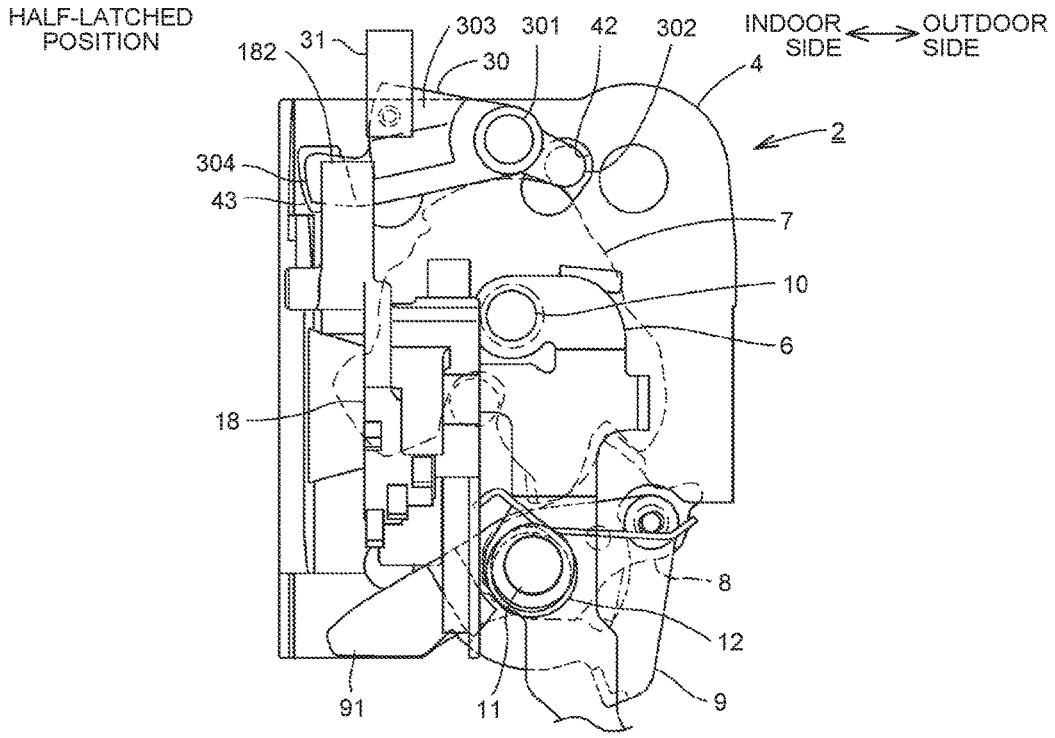
FIG. 8 is a rear view of the engaging unit at the half-latched position.
Figure 10:
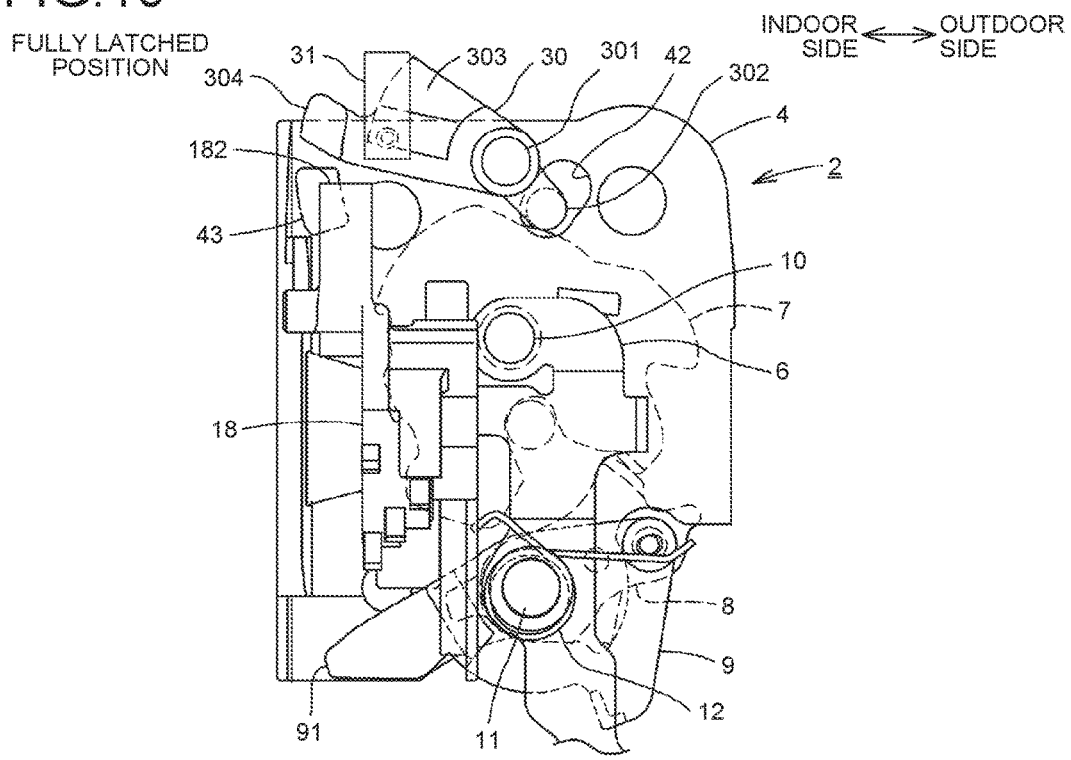
FIG. 10 is a rear view of the engaging unit at the fully-latched position.

As mainly illustrated in FIGS. 6, 8, and 10, on the reverse side of the body 4 opposite to the accommodating portion 41, a detection lever 30 that rotates in association with rotation of the latch 7 and a detection switch 31 that is turned ON and OFF according to rotational positions of the detection lever 30 are included. In a state where the door latch device 1 has been installed in the door, the reverse side of the body 4 is positioned inside the door, and thus as compared to the accommodating portion 41 facing the outside of the door, the reverse side of the body 4 is in an environment where dust, rainwater, and the like are difficult to be attached.

An approximately central portion of the detection lever 30 in a longitudinal direction (indoor-outdoor direction) is pivotally supported by a shaft 301 that is in the front-rear direction at an upper portion of the reverse side of the body 4, and the detection lever 30 is biased in a clockwise direction in FIGS. 6, 8, and 10 by a spring not illustrated. At one end portion of the detection lever 30 facing the outdoor side (the right end portion in FIGS. 6, 8, and 10), a detecting portion 302, which: penetrates through an elongated hole 42 that is in the up-down direction and that is provided at an upper portion of the body 4; protrudes to the accommodating portion 41 side of the body 4; and is relatively slidable along the cam portion 73 and the small diameter portion 74 of the latch 7, is provided. Further, on the other end portion at the opposite side across the shaft 301 of the detecting portion 302 (the left end portion in FIGS. 6, 8, and 10), a cam surface 303 that is for actuating the detection switch 31 and that bulges out forward, and a blocking portion 304 are provided. The blocking portion 304 allows movement of the lock lever 18 to the locked position when the latch 7 is in the fully latched position and blocks movement of the lock lever 18 to the locked position when the latch 7 is at a position other than the fully latched position.

The detecting portion 302 of the detection lever 30 abuts against the small diameter portion 74 of the latch 7 as illustrated in FIGS. 9 and 10 when the latch 7 is at the fully latched position, and abuts against the cam portion 73 as illustrated in FIGS. 5 to 8 when the latch 7 is at the half-latched position and the open position, which are other than the fully latched position. Thereby, when the latch 7 rotates from the fully latched position towards the open position, the detecting portion 302 relatively moves from the small diameter portion 74 of the latch 7 to the cam portion 73 of the latch 7, and thus the detection lever 30 rotates to an unlatch detection position illustrated in FIGS. 5 and 6 against biasing force of the spring from a latch detection position illustrated in FIGS. 9 and 10. Further, when the latch 7 moves to the fully latched position from the open position, the detection lever 30 rotates to the latch detection position from the unlatch detection position.

Figure 11:
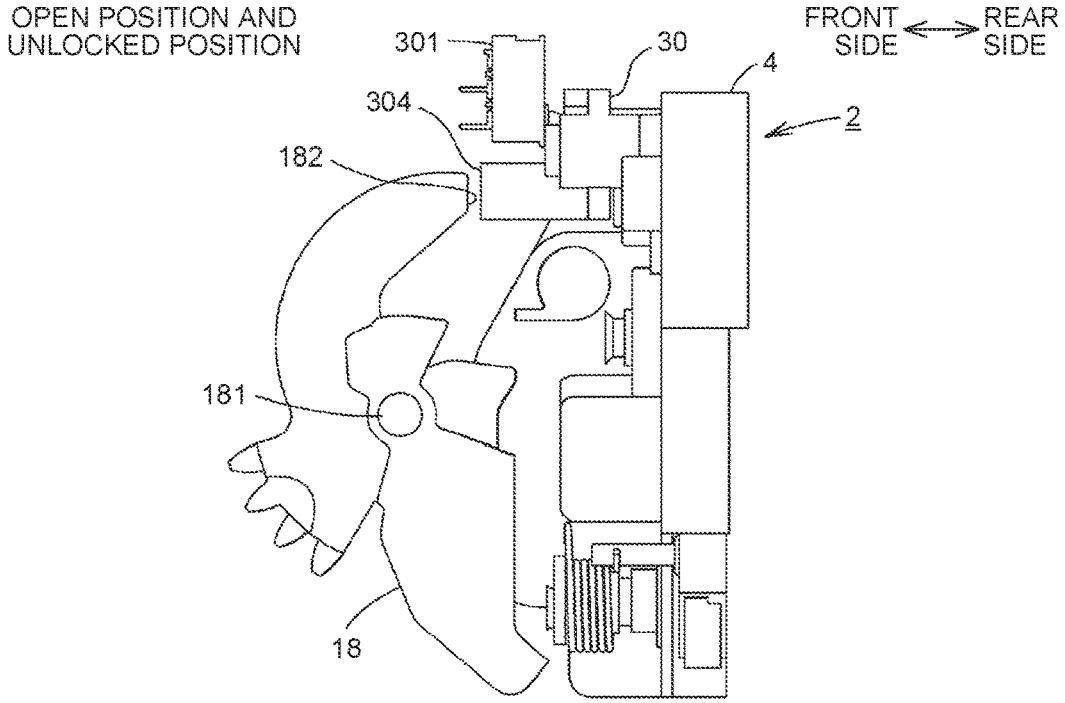
FIG. 11 is a side view of main parts when an engaging mechanism is at an open position and a locking and unlocking mechanism is at an unlocked position.
Figure 12:
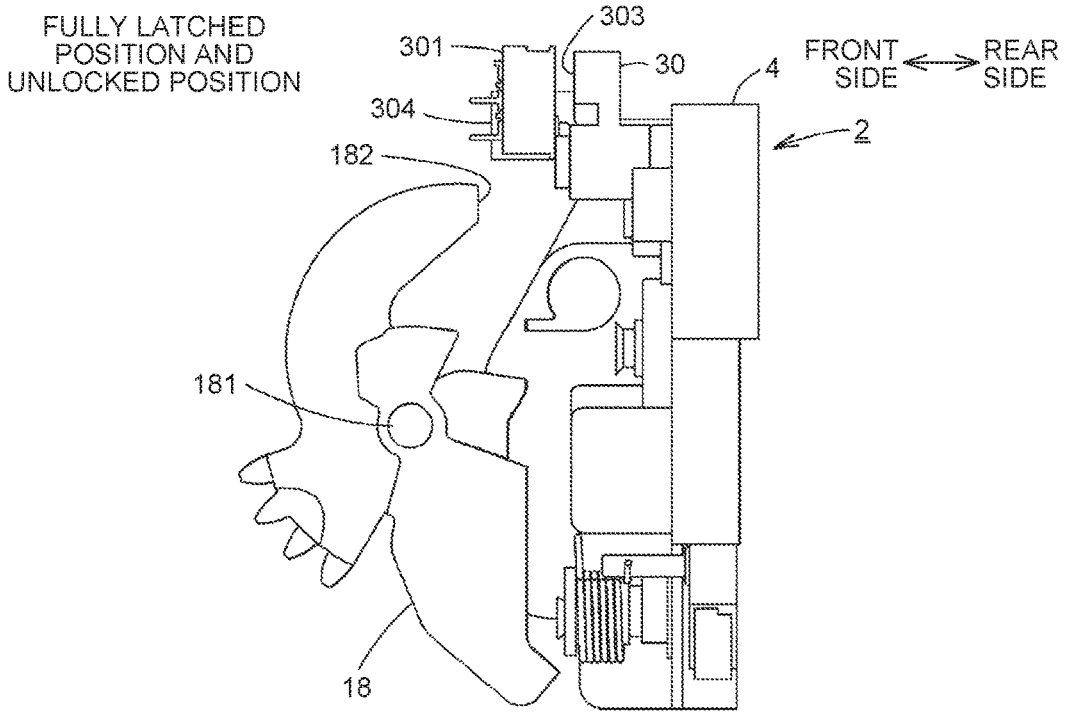
FIG. 12 is a side view of main parts when the engaging mechanism is at a fully-latched position and the locking and unlocking mechanism is at the unlocked position.
Figure 14:
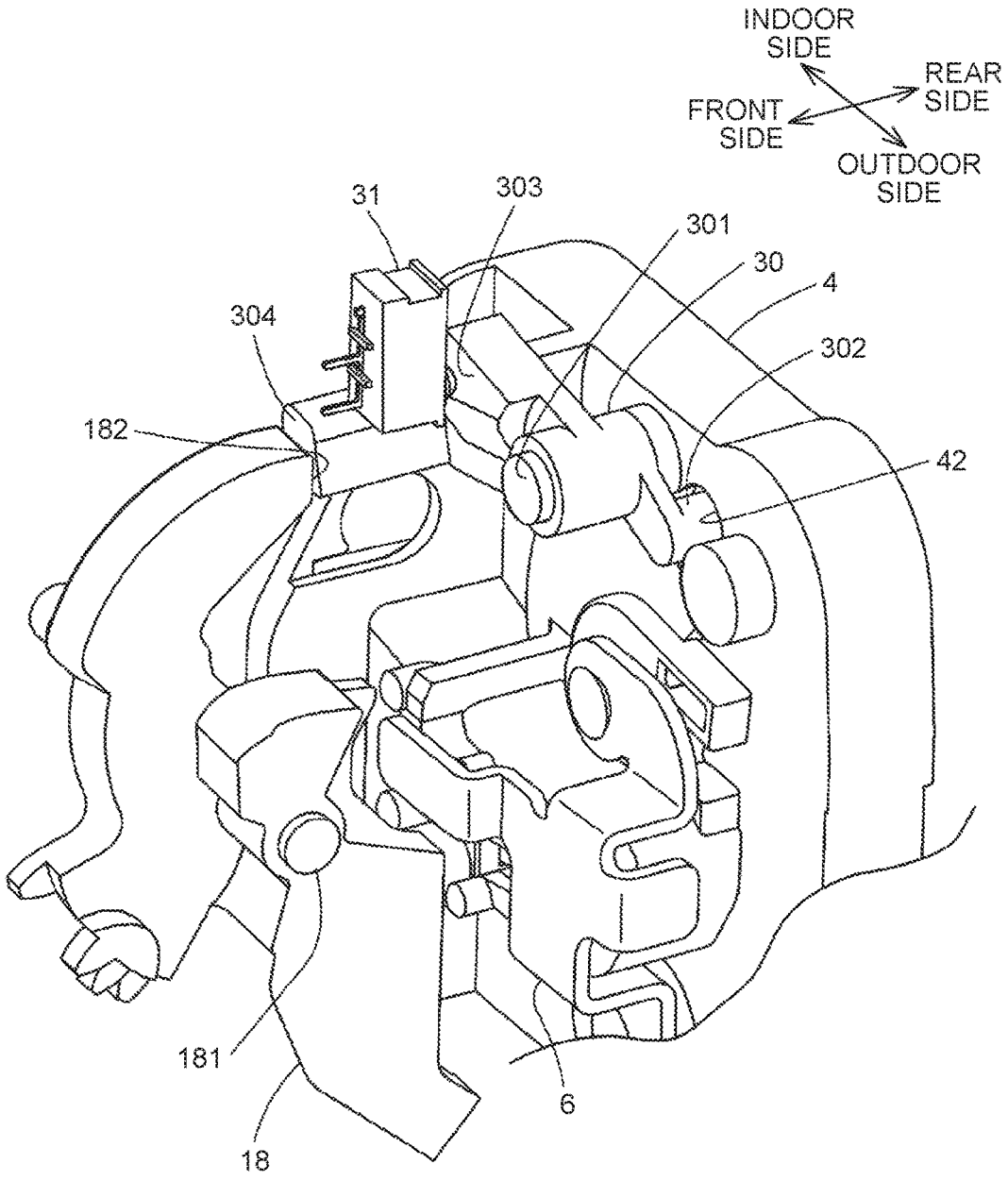
FIG. 14 is an enlarged perspective view of main parts when the engaging mechanism is at the open position and the locking and unlocking mechanism is at the unlocked position.
Figure 15:
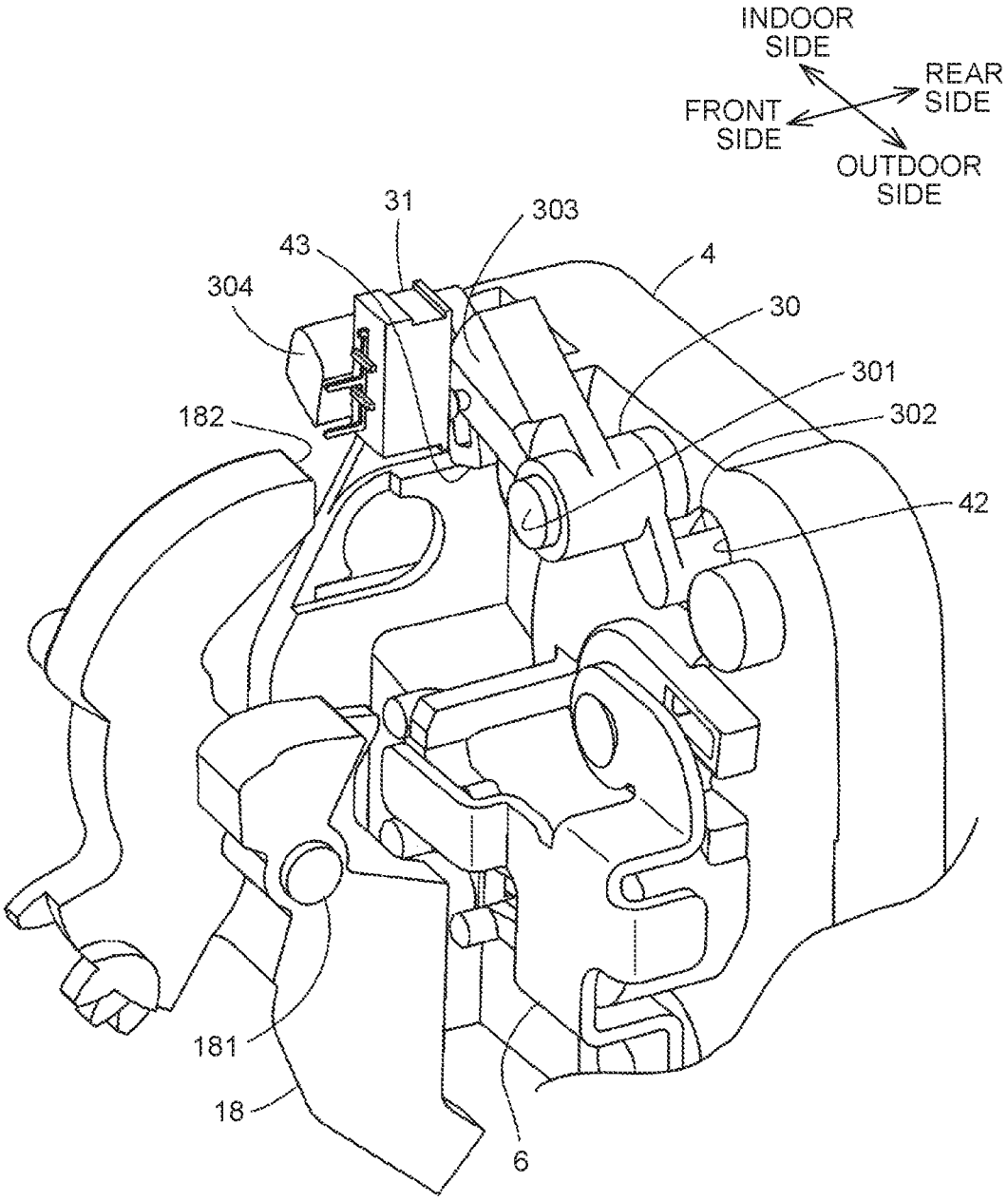
FIG. 15 is an enlarged perspective view of main parts when the engaging mechanism is at the fully-latched position and the locking and unlocking mechanism is at the unlocked position.

The blocking portion 304 protrudes forward from an end portion of the detection lever 30, and in a state where the detection lever 30 has rotated to the latch detection position, as illustrated in FIGS. 12 and 15, for example, the blocking portion 304 is retracted outside a movement track of a blocked portion 182 provided at an upper portion of the lock lever 18 (above the blocked portion 182), such that movement of the lock lever 18 from the unlocked position to the locked position is able to be allowed. On the contrary, in a state where the detection lever 30 has rotated to the unlatch detection position, as illustrated in FIGS. 11 and 14, for example, the blocking portion 304 is advanced into the movement track of the blocked portion 182 such that movement of the lock lever 18 from the unlocked position to the locked position is able to be blocked.

In a state where the blocking portion 304 of the detection lever 30 has advanced into the movement track of the blocked portion 182, the blocking portion 304 enters between the blocked portion 182 and a receiving portion 43 provided on the reverse side of the body 4. The receiving portion 43 is provided to protrude forward on a front side of the body 4.

The detection switch 31 is arranged at an upper portion of the body 4 to face the cam surface 303 of the detection lever 30. The detection switch 31 is turned OFF by separating from the cam surface 303 when the detection lever 30 rotates to the latch detection position, and is brought into an ON-state by coming into contact with the cam surface 303 when the detection lever 30 rotates to the unlatch detection position. An indoor light or the like is lit, for example, when the detection switch 31 is brought into the ON-state.

The motor 16 and various switches including the detection switch 31 are wired to a coupler 32 provided at an upper portion of the body 4. By an external connector, which is not illustrated, being connected to the coupler 32, electric power of an in-vehicle battery is supplied to the motor 16, and detection signals of the various switches are transmitted to an in-vehicle control circuit unit. Further, the detection switch 31 is held by a resin plate 34 in which a wiring 33 illustrated in FIG. 4 has been insert-molded. Thereby, wiring of the detection switch 31 is facilitated.

The lock lever 18 has the blocked portion 182 extending towards the reverse side of the body 4. When the detection lever 30 is at the latch detection position, since the blocking portion 304 of the detection lever 30 has retracted outside the movement track of the blocked portion 182, the lock lever 18 is able to move from the unlocked position to the locked position. Further, when the detection lever 30 is at the unlatch detection position, since the blocking portion 304 has advanced into the movement track of the blocked portion 182, movement of the lock lever 18 from the unlocked position to the locked position is blocked.

Figure 13:
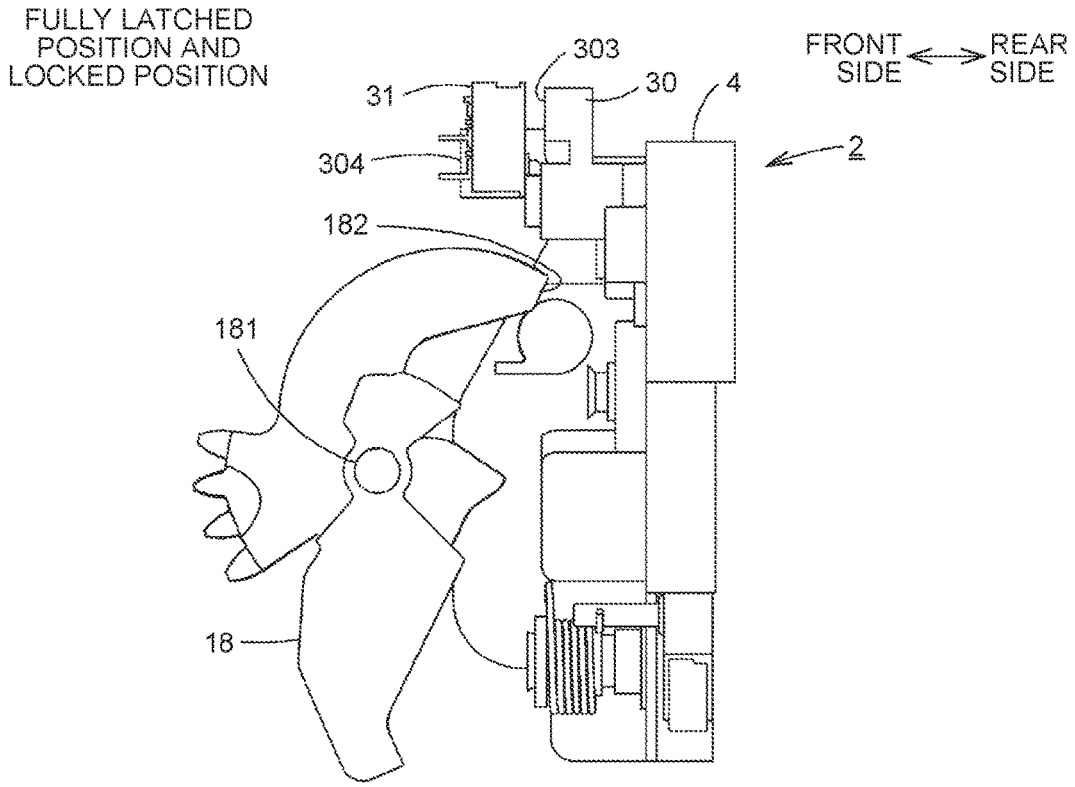
FIG. 13 is a side view of main parts when the engaging mechanism is at the fully-latched position and the locking and unlocking mechanism is at a locked position.

In a state where the door is closed, that is, when, as illustrated in FIGS. 9 and 10, the latch 7 is at the fully latched position and the detection lever 30 is at the latch detection position, the detection switch 31 is brought into an OFF state away from the cam surface 303 of the detection lever 30, and detects the fully closed state of the door. Further, the blocking portion 304 of the detection lever 30 is retracted outside the movement track of the blocked portion 182 of the lock lever 18. Therefore, in this state, as illustrated in FIG. 13, the lock lever 18 is rotatable to the locked position.

In a state where the door is open, that is, when, as illustrated in FIGS. 5 and 6, the latch 7 is at the open position and the detection lever 30 is at the unlatch detection position, the detection switch 31 is brought into the ON state by coming into contact with the cam surface 303 of the detection lever 30, and detects the open state of the door. Further, the blocking portion 304 of the detection lever 30 is advanced to between the blocked portion 182 of the lock lever 18 at the unlocked position and the receiving portion 43.

Therefore, in this state, even if the lock lever 18 and the open link 20 are attempted to be rotated, based on locking operation on the lock knob, to the locked position via the knob lever 19, by the blocked portion 182 of the lock lever 18 abutting against a surface of the blocking portion 304 of the detection lever 30, rotation of the locking and unlocking mechanism including the lock lever 18 to the locked position is blocked. Further, in this case, since a reverse surface of the blocking portion 304 abuts against the receiving portion 43 of the body 4, the rotation of the lock lever 18 to the locked position is able to be surely blocked and inclination deformation of the detection lever 30 is able to be suppressed.

As described above, switch-over operation to the locked position of the locking and unlocking mechanism in a state where the door is open is able to be blocked and lock-up of the key inside the vehicle is able to be prevented.

Further, by provision of the detection lever 30 and the detection switch 31 on the reverse side of the body 4, attachment of dust, rainwater, and the like onto the cam surface 303 of the detection lever 30 and the detection switch 31 is able to be suppressed to the minimum, and thus excellent waterproofness is achieved, and the open and closed states of the door are able to be surely detected over a long period of time.

REFERENCE SIGNS LIST

1 DOOR LATCH DEVICE
2 ENGAGING UNIT
3 OPERATING UNIT
4 BODY
5 COVER PLATE
6 BACK PLATE
7 LATCH (ENGAGING MECHANISM)
8 RATCHET (ENGAGING MECHANISM)
9 OPEN LEVER
10 LATCH SHAFT

11 RATCHET SHAFT
12 SPRING
15 CASING
16 MOTOR
17 WORM WHEEL
18 LOCK LEVER (LOCKING AND UNLOCKING MECHANISM)
19 KNOB LEVER (LOCKING AND UNLOCKING MECHANISM)
20 OPEN LINK (LOCKING AND UNLOCKING MECHANISM)
21 INSIDE LEVER
22 KEY LEVER
23 OUTSIDE LEVER
24 SPRING
30 DETECTION LEVER
31 DETECTION SWITCH
32 COUPLER
33 WIRING
34 RESIN PLATE
41 ACCOMMODATING PORTION
42 ELONGATED HOLE
43 RECEIVING PORTION
71 FULL LATCH ENGAGING PORTION
72 HALF LATCH ENGAGING PORTION
73 CAM PORTION
74 SMALL DIAMETER PORTION
91 RELEASED PORTION
171 SHAFT
181 SHAFT
182 BLOCKED PORTION
191 SHAFT
201 RELEASING PORTION
211 SHAFT
221 SHAFT
231 SHAFT
301 SHAFT
302 DETECTING PORTION
303 CAM SURFACE
304 BLOCKING PORTION

The invention claimed is:

1. A vehicle door latch device, comprising:

a base fixed to a door;

a latch pivotally supported on a surface side of the base, and configured to be rotatable between a fully latched position and an open position in association with open and closed states of the door, the latch having a cam portion on an outer periphery thereof;

a locking and unlocking mechanism including at least one portion configured to be switchable, based on operation of a locking and unlocking operation unit provided in the door, to an unlocked position where opening operation on an operation handle provided on the door is validated and to a locked position where the opening operation on the operation handle is invalidated;

a detection lever pivotally supported on a reverse side of the base by a shaft parallel with an axial direction of the latch, the detection lever having a detecting portion, which penetrates through an elongated hole provided in the base into the surface side and slides along the cam portion in association with rotation of the latch, and a cam surface provided on an opposite side of the detecting portion across the shaft, the detection lever being configured to be rotatable, by the detecting portion sliding along the cam portion in association with rotation of the latch, to a position corresponding to a rotational position of the latch; and a detection switch provided on the reverse side of the base and configured to be able to detect the open and closed states of the door by being turned ON and OFF by coming into contact with and separating from the cam surface in association with rotation of the detection lever, wherein the detection lever further has a blocking portion that allows the at least one portion of the locking and unlocking mechanism to switch-over to the locked position when the blocking portion is located out of a movement track of the at least one portion of the locking and unlocking mechanism and when the blocking portion is at a first rotational position corresponding to the fully latched position of the latch, and blocks the switch-over of the at least one portion of the locking and unlocking mechanism to the locked position when the blocking portion is located in the movement track of the at least one portion of the locking and unlocking mechanism and when the blocking portion is at a second rotational position corresponding to a position other than the fully latched position of the latch, the cam surface of the detection lever has a shape that bulges out in the axial direction, the detection switch is arranged to face the cam surface, wherein the at least one portion of the locking and unlocking mechanism is configured to be rotatable about a shaft orthogonal to the shaft of the detection lever, and to be prevented from rotating to the locked position by abutting against a surface of the blocking portion when the detection lever is at the second rotational position.

2. The vehicle door latch device according to claim 1, wherein the base has a receiving portion against which a reverse surface of the blocking portion is abuttable when the detection lever is at the second rotational position and the blocking portion is blocking rotation of the at least one portion of the locking and unlocking mechanism to the locked position.

* * * * *